US005593326A

United States Patent [19]

Listing

[11] Patent Number: 5,593,326

[45] Date of Patent: Jan. 14, 1997

[54] ELECTRICAL CONNECTOR WITH SECONDARY LATCH

[75] Inventor: Martin Listing, Langen, Germany

[73] Assignee: The Whitaker Corporation, Wilmington, Del.

[21] Appl. No.: 411,007

[22] Filed: Mar. 27, 1995

[30] Foreign Application Priority Data

Apr. 13, 1994 [DE] Germany ..... 9407293.1

[51] Int. Cl.[6] ..... H01R 13/514

[52] U.S. Cl. ..... 439/752; 439/274

[58] Field of Search ..... 439/752, 326, 439/595, 271–274

[56] References Cited

U.S. PATENT DOCUMENTS

| | | | |
|---|---|---|---|
| 4,583,805 | 4/1986 | Mantlik | 339/61 R |
| 4,778,231 | 10/1988 | Seidler et al. | 439/857 |
| 4,944,688 | 7/1990 | Lundergan | 439/752 |
| 4,973,268 | 11/1990 | Smith et al. | 439/752 |
| 5,037,336 | 8/1991 | Betsui | 439/752 |
| 5,059,142 | 10/1991 | Ohta et al. | 439/752 |
| 5,066,252 | 11/1991 | Kato et al. | 439/752 |
| 5,116,236 | 5/1992 | Colleran et al. | 439/752 |
| 5,186,662 | 2/1993 | Yuasa et al. | 439/752 |

FOREIGN PATENT DOCUMENTS

| | | | |
|---|---|---|---|
| 0356222 | 2/1990 | European Pat. Off. | H01R 13/424 |

*Primary Examiner*—David L. Pirlot
*Assistant Examiner*—Eugene G. Byrd

[57] ABSTRACT

An electrical connector comprising a housing having a body with a cavity therein for receiving an electrical contact further including a secondary latch having a first position thereupon adjacent the cavity and a second position where the latch extends into the cavity to assure retention of the contact. The electrical connector characterized in that the secondary latch includes first bearing surfaces in contact with the body when the latch is in the first position and second bearing surfaces, laterally offset from the first bearing surfaces that contact the body when the latch is in the second position, where the latch offsets laterally between bearing surfaces in response to further insertion of the latch upon the body.

10 Claims, 2 Drawing Sheets

ELECTRICAL CONNECTOR WITH SECONDARY LATCH

BACKGROUND OF THE INVENTION

1. Field of the Invention

The present invention relates to an electrical connector having a secondary latch member to assure retention of a contact therein.

2. Description of the Prior Art

Electrical connectors having secondary latch members to assure retention of contacts therein are well known in the industry. These connectors have found widespread use in high vibration environments where it is necessary to assure that the contact remains positively retained in order to maintain the integrity of the electrical interconnection, for example in automotive applications. One known configuration includes resilient latch arms upon the secondary latch member that are cammed into engagement with the contact as the latch member is inserted into the electrical connector housing. Another known configuration is to include the latch arms as part of the connector housing and have the secondary latch member serve as a back-up element insertable once the contacts have been placed within the connector, thereby preventing subsequent deflection of the latch arms. By their nature, these resilient latch arms are flexible and therefore subject to damage as a result of handling and improper insertion. What is needed is a more robust secondary latch member that is also simple to actuate.

SUMMARY OF THE INVENTION

It is an object of this invention to provide a robust secondary latch useable with an electrical connector to assure retention of electrical contacts therein.

This object is accomplished by providing a secondary latch that is matable with the body of an electrical connector to retain contacts therein, characterized in that the secondary latch includes first bearing surfaces that are in contact with the body portion when the secondary latch is in a first position, enabling contacts to be inserted into the connector, and second bearing surfaces, laterally offset from the first bearing surfaces, which are in contact with the body portion when the secondary latch is displaced to a second position for assuring retention of the contacts within the electrical connector. The secondary latch being laterally displaceable from the first bearing surfaces to the second bearing surfaces as a result of longitudinal displacement of the secondary latch.

It is an advantage of this invention, that because the latch is being displaced rather than a latch arm being deflected, the latch may be more robust. It is another advantage of this invention, that the latch is installable upon the connector by longitudinal actuation. It is yet another advantage of this invention that as the latch is more robust, a shoulder may be formed thereupon to engage a seal upon the body of the electrical connector to form a fluid tight connection with a mating connector.

DETAILED DESCRIPTION OF THE PREFERRED EMBODIMENT

Figure 1:
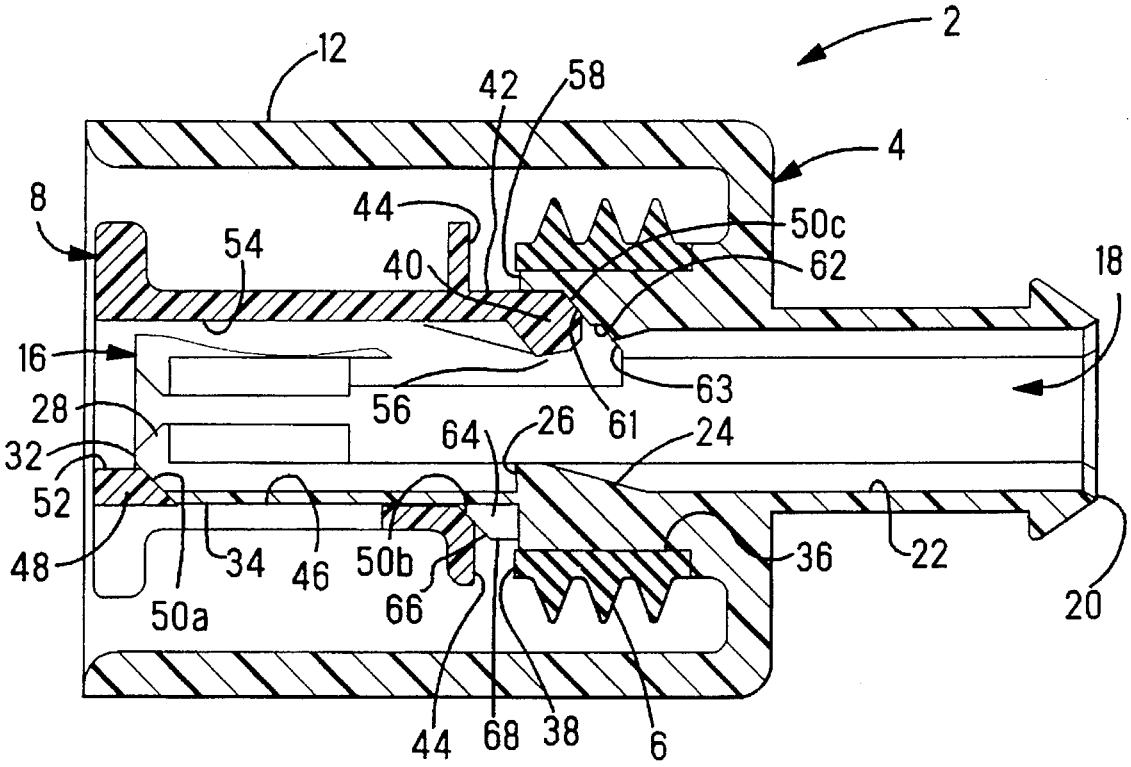
FIG. 1 is a longitudinal sectional view of a sealable electrical connector for receiving an electrical contact comprising a housing and a secondary latch member shown in a first position to enable insertion of a contact therein.

With reference first to FIG. 1, an electrical connector is shown generally at 2. The electrical connector 2 includes a housing 4, a resilient seal 6 and a secondary latch 8 for assuring that electrical contacts 10 (shown in FIG. 3) are retained therein. The housing 4 includes an outer shell 12 that may be adapted for retention of a mating electrical connector 14 (FIG. 3) and a body 16 that is interconnected to the shell 12.

Figure 3:
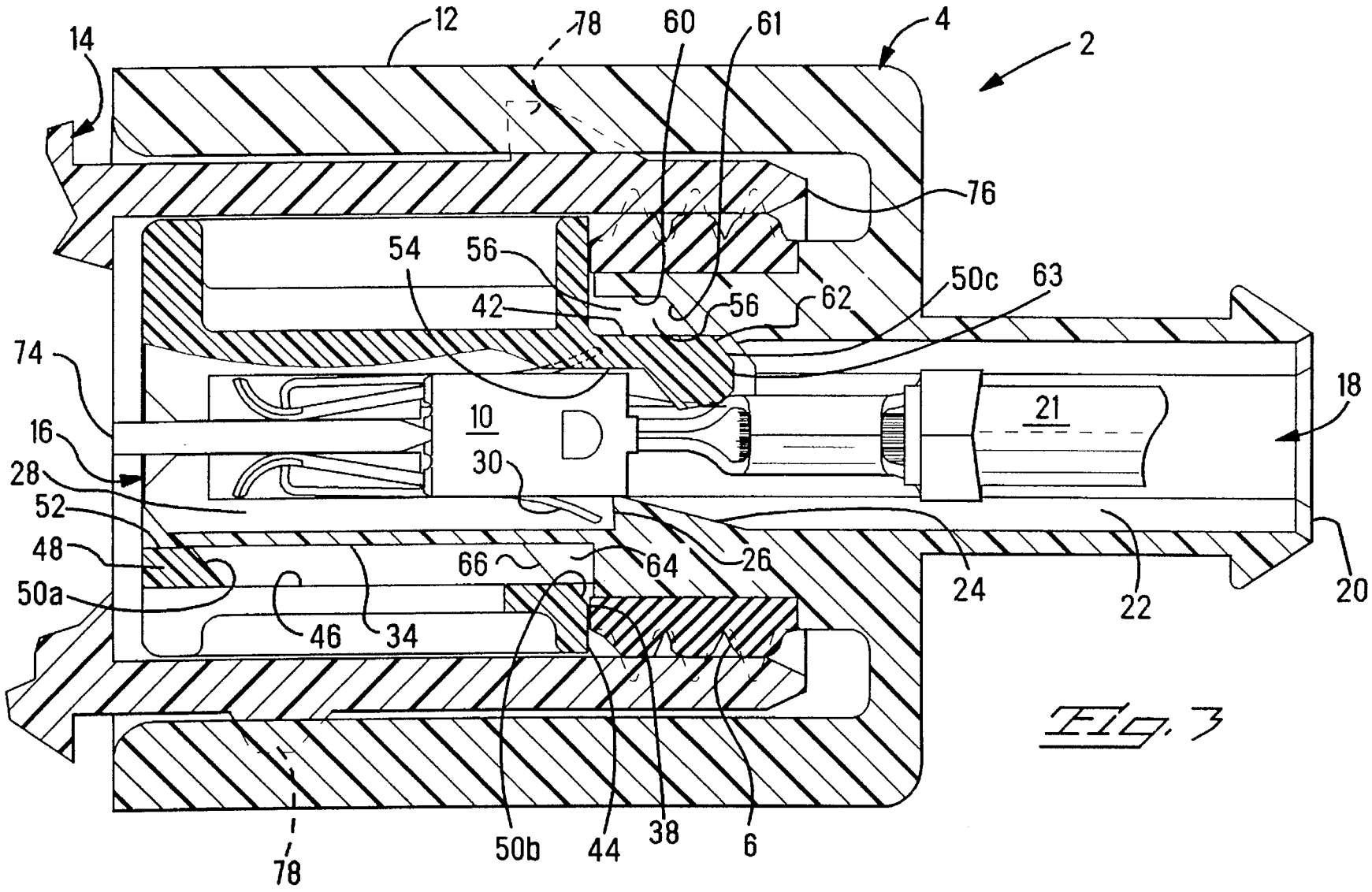
FIG. 3 is a longitudinal sectional view of the electrical connector of FIG. 1 including an electrical contact therein and the secondary latch member in the second position, illustrated in FIG. 2, further illustrating a representational mating electrical connector.

The body 16 includes a cavity 18 for receiving an electrical contact 10 therein. The cavity 18 extends into the body from a rear end 20 which is configured to provide strain relief and sealing for the electrical conductor 21 that is attached to the electrical contact 10, in a conventional manner. Inward of the back end 22 of the cavity 18, a reduced cross-sectional portion 24 forms a shoulder 26 where it meets with the front end 28 of the cavity 8. With reference to FIG. 3, shoulder 26 is formed for engagement with locking lances 30 of the electrical contact 10.

The body 16, where it is encompassed by the outer shell 12, includes a front end 28 from which a rearwardly extending nose portion 34 meets seal seat 36. Seal seat 36 is constructed to receive a resilient band-like seal 6 thereupon, such that a front edge 38 of the seal extends outward from the seat 36 in order to enable loading of the resilient seal 6 such that a fluid tight interconnection may be formed. An opening 56 extends through a wall 58 located where the nose portion 34 transitions to seal seat 36. The opening 56 extends through the body 16 into cavity 18. The opening 56 is bounded by first position back-up surface 60, camming surface 61, second position back-up surface 62 and cam surface 63. Opposite the opening 56 in the body 16 is a body step member 64 having angled cam surface 66 and bearing surface 68 thereupon.

The latch member 8 includes a inwardly directed retention member 40 upon latch arm 42 for assuring retention of the contact 10 within the cavity 18, as best shown in FIG. 3. Rearward of latch arm 42 is shoulder 44 that is continuous about the latch 8 and will come into contact with the front edge 38 of seal 6 when the latch 8 is fully inserted in order to load the seal 6 upon the seal seat 36. The latch 8 is constructed to fit over nose 34, along inner surface 46 which is a first bearing surface for the latch 8, so that when assembled with the body 16 the latch 8 is in a first position, as shown in FIG. 1. The secondary latch 8 further includes a step 48 extending inward from inner surface 46. The step 48 includes an angled camming surface 50*a* transitioning between inner surface 46 and surface 52. Surface 52 is a second bearing surface that engages the nose portion 34 when the secondary latch 8 is in the second position, shown in FIG. 2.

In addition to cam surface 50*a*, at step 48, the secondary latch 8 includes cam surfaces 50*b* between inner surface 46 and shoulder 44, and cam surface 50*c* upon retention member 40. These cam surfaces 50*a*, 50*b*, 50*c* assist in displacing the secondary latch 8 laterally from the first position, shown in FIG. 1, to the second position, shown in FIG. 2, in response to further longitudinal movement of the latch 8. Opposite inner surface 46 of the latch 8 is opposing surface 54 that when the latch 8 is initially positioned in the first position, as shown in FIG. 1, is spaced away from the body 16.

As shown in FIG. 1, as latch member 8 is inserted longitudinally upon the nose portion 34 of the body 16, inner surface 46 rides against the nose portion 34 while inner surface 54 is offset therefrom enabling retention member 40 to pass thereover. When the retention member 40 reaches opening 56 it is received therein. FIG. 1 shows the secondary latch 8 in the first position with the retention member 40 adjacent to the cavity 18 so that contact 10 may be inserted into the cavity 18. In this position the latch arm 42 is closely adjacent first position back-up surface 60, camming surface 50*c* of the retention member 40 is closely adjacent camming surface 61 and inner surface 46 bears against nose portion 34. Additionally, camming surfaces 50*a* and 50*b* of the latch 8 are adjacent lead-in surface 70 of the nose portion 34 and cam surface 66 of the body step 64 respectively.

Figure 2:
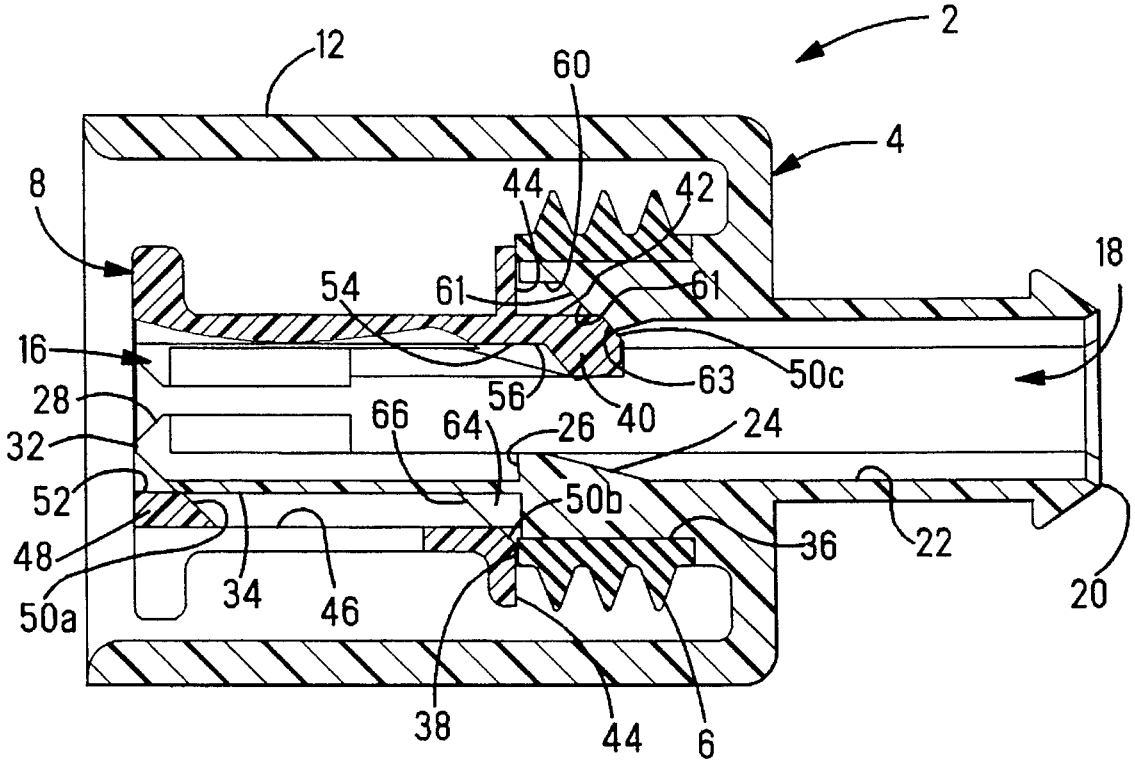
FIG. 2 is a longitudinal sectional view of the electrical connector of FIG. 1 showing the secondary latch in a second position where an electrical contact therein would be retained.

With reference now to FIG. 2, as a result of further longitudinal movement of the latch 8, interaction occurs between cam surfaces 50*a*, 50*b*, 50*c* of the secondary latch 8 and lead-in surface 70, cam surface 66 of the body step 64, and cam surface 61 between the first position back-up surface 60 and second position back-up surface 62 within opening 56 to cause the secondary latch 8 to be offset laterally as it moves forward longitudinally into the second position shown in FIG. 2 and FIG. 3. In this position, the secondary latch 8 has now shifted so that it is received on the nose portion 34 with second bearing surfaces engaged therewith. As can be seen in FIG. 3, opposing surface 54 of latch 8 is now closely adjacent nose portion 34, step surface 52 now bears on nose portion 34, and a portion of inner surface 46 bears upon body step surface 68, while inner surface 46 is now laterally spaced away from the nose portion 34. In this second position, latch arm 42 abuts the position 2 back-up surface 62 and cam surface 50*c* is closely adjacent cam surface 66. Shoulders 44 compressively engage seal 6 to form a fluid tight connection therebetween. This lateral shifting of the secondary latch 8, best viewed by comparing the position of the latch in FIG. 1 to that of FIG. 2 or FIG. 3, results in retention member 40 moving into a position where it would assure retention of an electrical contact 10 disposed within the cavity 18, as best shown in FIG. 3.

With reference now to FIG. 3, the electrical contact 10 connected to a conductor 21 is disposed within the cavity 18. The secondary latch 8 is in the second position, thereby assuring the contact 10 remains within the cavity 18 and engaged with terminal 74, shown in this embodiment as a tab or pin style terminal, of mating connector 14. Mating connector 14 includes a shell 76 that is received between the body 16 and the outer shell 12 of the housing 4. Retention studs 78 included on the shell 76 of mating connector 14 retain the mating connector with the housing 4. The seal 6 is elastically deformed about the seal seat 36 of body 16, the shell 76 of the mating connector 14 and secondary latch 8 to provide a fluid tight seal therebetween, thereby prevent the ingress of moisture that would contaminate the electrical connection.

Advantageously, as the latch member 8 itself moves laterally in response to further insertion along a longitudinal direction, with respect to the latch, it is not necessary that latch arm 42 be resilient, thereby enabling a more robust secondary latch 8. Furthermore, as the secondary latch 8 is more robust, shoulders 26 can be included thereon for compressing the seal 6 to form a fluid tight seal, thereby making the secondary latch 8 especially suitable for use in a sealed connector.

I claim:

1. An electrical connector comprising a housing having a body with a cavity therethrough for receiving a contact, the body having a nose portion and an opening transversely across and into communication with the cavity, the connector further including a secondary locking member for retaining the contact within the cavity, the secondary locking member being fitted at the nose portion and including a retention member that is receivable through the opening, a first bearing surface and a second bearing surface, the secondary locking member having a first position where the retention member is sufficiently clear of the cavity such that the contact can be inserted as removed therefrom and the first bearing surfaces correspond to the nose portion and a second position where the retention member extends through the opening and into the cavity for cooperation with a shoulder of the contact to prevent withdrawal of the contact and the second bearing surfaces correspond to the nose portion, the secondary locking member being displaceable transversely and longitudinally between the first and second positions.

2. The electrical connector of claim 1, wherein the secondary locking member is of shell-like construction and in the first position is laterally offset from the nose portion.

3. The electrical connector of claim 2, wherein the bearing surfaces are on opposite sides of the shell and correspond to opposite sides of the nose portion.

4. The electrical connector of claim 1, wherein the nose portion and secondary locking member include camming surfaces for transversely shifting the secondary locking member as a result of a longitudinal face.

5. The electrical connector of claim 1, wherein the body includes a back-up surface at the opening such that the back-up surface overlies the retention member in the second position to prevent the retention member from backing out of the cavity.

6. The electrical connector of claim 2, wherein the connector housing further includes an outer shell surrounding the nose portion, a mating connector being receivable in an annular cavity formed between the nose portion and the outer shell, said annular cavity being obstructed by the secondary locking member when in the first position, thereby preventing mating of the mating connector until the secondary locking member is in the first position.

7. The electrical connector of claim 6, wherein the connector housing includes a seal seat behind the opening for receiving a seal thereupon in order to form a sealable connector.

8. The electrical connector of claim 2, wherein the secondary locking member is substantially rigid.

9. The electrical connector of claim 7, wherein the secondary locking member includes a shoulder for cooperating with the seal to retain the seal upon the seal seat.

10. An electrical connector comprising a housing having a body with a cavity therethrough for receiving a contact, the body having a nose portion and an opening transversely across and into communication with the cavity, the connector further including a secondary locking member for retaining the contact within the cavity, the secondary locking member being fitted at the nose portion and including a retention member that is receivable through the opening, a first bearing surface and a second bearing surface, the secondary locking member having a first position where the retention member is sufficiently clear of the cavity such that the contact can be inserted as removed therefrom and the first bearing surfaces correspond to the nose portion and a second position where the retention member extends through the opening and into the cavity for cooperation with a shoulder at the contact to prevent withdrawal of the contact and the second bearing surfaces correspond to the nose portion, the secondary locking member and the nose portion having cooperating camming surfaces such that the secondary locking member is displaceable transversely and longitudinally between the first and second positions as a result of cooperation between the camming surfaces.

* * * * *